United States Patent [19]

Hayashi et al.

[11] 4,031,498

[45] June 21, 1977

[54] NON-LINEAR VOLTAGE-DEPENDENT RESISTOR

[75] Inventors: Masahiro Hayashi; Masanori Haba; Misuzu Watanabe; Shinji Hirano, all of Tokyo, Japan

[73] Assignee: Kabushiki Kaisha Meidensha, Tokyo, Japan

[22] Filed: Oct. 24, 1975

[21] Appl. No.: 625,515

[30] Foreign Application Priority Data

Oct. 26, 1974 Japan ..... 49-123730
Oct. 16, 1975 Japan ..... 50-124603

[52] U.S. Cl. ..... 338/21; 29/610 R; 252/518

[51] Int. Cl.[2] ..... H01C 7/10

[58] Field of Search ..... 338/20, 21; 252/518 A, 252/518 R; 317/61; 427/101, 103, 126; 29/610; 264/61, 64; 428/411

[56] References Cited

UNITED STATES PATENTS 3,857,174 12/1974 May ..... 252/518 A
3,872,582 3/1975 Matsuoka et al. ..... 252/518 A

*Primary Examiner*—C. L. Albritton

[57] ABSTRACT

A non-linear voltage dependent resistor having a non-ohmic resistance element and an electrically insulating coating formed thereon, obtained by firing a formed element containing zinc oxide and a coating material applied thereon, at a temperature between 900° and 1,400° C, the coating material including a mixture of ZnO, $SiO_2$, $Bi_2O_3$ and $Sb_2O_3$. There is formed a firm joint between the resistance element and the insulating coating and the insulating coating has a composition structure wherein fine constituent grains are closely packed whereby the occurrence of a flashover is prevented.

23 Claims, 13 Drawing Figures

All of 50 sample resistors having identical coating thicknesses respectively have withstood corresponding current crest values.

NON-LINEAR VOLTAGE-DEPENDENT RESISTOR

FIELD OF THE INVENTION

The present invention relates to a voltage-dependent resistor and, in particular, to a non-linear resistor for use with a lightning-arrester, a surge-absorber, etc.

DESCRIPTION OF THE PRIOR ART

Generally speaking, a non-linear resistor does not obey Ohm's law and has a non-linear voltage versus current characteristic that, as a voltage which is applied across the resistor increases, the resistance of the resistor inversely decreases, thereby increasing the current flowing through the resistor. Non-linear resistors are thus very useful in apparatus, such as lightning arresters or surge absorbers, for absorbing unusually high voltages. An SiC (Silicon carbide) lightning arrester characteristic element and an SiC variestor are typical of non-linear resistors. Either of them utilizes the fact that the contact resistances between the SiC grains included therein change depending on the voltage applied thereacross. Each of these elements has been manufactured by a process which includes the steps of molding a predetermined amount of a mixture of SiC grains and a binder of procelain clay to a desired form and sintering the molding thus obtained at a predetermined temperature. Each of these elements has a voltage-current characteristic approximately represented by $$I = (V/C)^{\alpha}$$

where $I$ is the electric current flowing through the element, $V$ is the voltage applied across the element, $C$ is a constant (corresponding to the resistance of the element), and $\alpha$ is the non-linear index.

An SiC lightning arrester element has an $\alpha$ of about from 3 to 7 only when the current flowing through the element is in the range of from a few hundreds to 20,000 amperes. Beyond this current range, on the other hand, the characteristic element shows a substantial ohmic resistance. When lightning arresters incorporating SiC characteristic elements are connected directly to corresponding power transmission lines, they must have several spark gaps in series to obtain electric insulation between the lines and ground. Conventional high to extremely high voltage lightning arresters incorporate numerous spark gaps and characteristic elements therein as well as a number of capacitors or resistors in parallel with the gaps in order to equalize the voltages applied across the spark gaps of the arresters.

The provision of numerous gaps, capacitors and resistors in a lightning arrester leads to the enlargement of the size of its insulator housing which makes the arrester more expensive and, in addition, the gaps act to give an adverse effect on the response to sharp surges and on the breaking off of resultant follow currents.

A number of non-linear oxide semiconductor resistors have recently been produced by molding a predetermined amount of a mixture of zinc oxide (ZnO), bismuth oxide ($Bi_2O_3$) and other additives into a body of a desired form such as a disc, column etc. of a desired size, which will finally become a resistance element, sintering it at an appropriate high temperature, coating the side surface of the sintered body thus obtained with an epoxy resin and attaching electrodes to each end of the product.

These resistors have a non-linear index $\alpha$ of about 50 when the current flowing therethrough are in the order of milliamperes. This shows that the resistors just described exhibit excellent non-linearity and a considerably high dielectric constant compared with those manufactured previously. The use of these resistors could therefore result in obtaining lightning arresters that do not have spark gaps.

Since, however, the non-linear resistors also include an epoxy organic compound as electrically insulating coatings on the sintered body, the joint of the coating to the body is not good and moisture is apt to collect in between the body and the coating. Such resistors are therefore likely to be subjected to deterioration of their characteristic and to have a poor ability to withstand a high impulse current (current wave form $4 \times 10$ us) to be later described.

There is a considerable difference between the coefficient of thermal expansion ($8 \times 10^{-6}/°$ C) of such resistance elements and that ($30 \times 10^{-6}/°$ C) of the epoxy resin covering the side surfaces of the elements and therefore the epoxy resin is likely to crack due to thermal shock, thereby also lowering the voltage-current characteristic of the resistors. An organic compound material such as epoxy resin used as insulating coatings of the resistors is likely to be deteriorated by small corona and arc discharges occurring on the resistors thereby causing deterioration of their characteristics.

When a high impulse current flows through the resistor, a flashover will occur along the side surface of the resistor irrespective of the characteristic of the resistor. Therefore, such resistors can not be used with a device, such as a lightning arrester, for absorbing an impulse current, as they are. It is considered that the flashover will be a combination of many small sparks produced on the side surface of the resistor by the flow of the high current through the resistor.

It would be possible to greatly enhance the ability of the resistor to withstand a high impulse current if (1) either the creation of sparks at an resistance element of the resistance or (2) the reaching of the sparks created to the outer surface of an electrically insulating coating of the resistor is suppressed.

As for the point (1), it is necessary to form a transitional area between the resistance element of the resistor and the electrically insulating coating thereon, which transitional area gives a strong chemical combination therebetween, has continuous resistivity and concentration slopes from one of the insulating coating and the resistance element to the other, and has no voids therein.

As for the point (2), it is necessary to form a fired and mechanically strong insulating coating of closely packed fine constituent grains thereby to suppress a partial separation of the insulating coating from the resistance element due to the creation of the sparks. Although the partial separation of the insulating coating is suppressed, however, the paths of the sparks reaching from the resistance element to the outer surface of the resistor and formed between the grains constituting the insulating coating would be shortened if the grains are large. Therefore, on the contrary, if the insulating coating is a sintered one of closely packed fine grains, it could lengthen the paths of the sparks.

If a coating material which is to finally become an electrically insulating coating and which is applied to the side surface of a formed element which is to finally become an electric resistance element, is melted at the firing stage of the manufacturing process, the resultant insulating coating would lack in homogeneousness, be porous and mechanically weak. As a result, the insulating coating would be easily separated from the resistance element. Therefore, the melting of the coating material on the formed element should be avoided by any means.

SUMMARY OF THE INVENTION

It is, therefore, an object of the present invention to provide a non-linear resistor having a good ability to withstand a high impulse current.

Another object of the present invention is to provide a non-linear resistor including a resistance element closely and firmly covered by an inorganic electrically insulating coating whereby the occurrence of sparks between the insulating coating and the element are prevented.

Still another object of the present invention is to provide a non-linear resistor wherein an inorganic electrically insulating coating of densely packed fine grains is formed on a resistance element. The paths of possible sparks across the insulating coating are thus lengthened thereby making it difficult for the sparks to appear at the outer surface of the coating.

Basically, the present invention is to form an electrically insulating coating on the side surface of a resistance element having a good non-linear voltage-current characteristic and a high dielectric constant by coating the side surface of a formed element, which includes zinc oxide (ZnO) and which will finally become the resistance element, with a coating material including a mixture of zinc oxide (ZnO), silicon dioxide ($SiO_2$), bismuth oxide ($Bi_2O_3$), and antimony trioxide ($Sb_2O_3$) which is the starting material of the insulating coating, and firing the intermediate product thus obtained at a temperature of from about 900° to 1,400° C. The main constituents of the insulating coating are zinc antimony oxide ($Zn_{7/3}Sb_{2/3}O_4$) of a spinnel structure and zinc orthosilicate ($Zn_2SiO_4$).

One feature of the present invention is that the coating material on the formed element of the resistor includes the same ingredient, ZnO, as the formed element, as mentioned above. The ZnO ingredients at the interface between the formed element and the coating material thereon will react with each other at the interface between the coating material and the formed element at a temperature of about from 900° to 1,400° C by the medium of melted $Bi_2O_3$ ingredient thereby forming a interface area between the resultant insulating coating and the resistance element in spite of a possible slight difference in shrinkage profile between the formed element and the coating material. The $Zn^{2+}$ ions produced in the formed element will diffuse through the interface area into the coating material thereby to bring about a continuous concentration slope of composition from one of the formed element and the coating material to the other. At the same time, the coating material reacts by itself to produce a fired insulating coating including compounds $Zn_{7/3}Sb_{2/3}O_4$ and $Zn_2SiO_4$, having a high electric resistance and a composition structure of densely packed fine grains. The inclusion of the ZnO compounds in the coating material will cause the coating material itself to react thereby to produce high melting-point products which may be $Z_{7/3}Sb_{2/3}O_4$ and $Zn_2SiO_4$. This prevents the coating material from being melted, porous and void. The ZnO in the coating material also serves to control the quantity of $Zn^{2+}$ ions diffusing out of the formed element during the firing thereby to suppress the production and the crystal growth of $Zn_2SiO_4$.

If the coating material does not include ZnO, the coating material would react with ZnO diffusing out of the formed element and form an interface area between the formed element and the coating material and then by itself react to form electric insulations during the firing. At the same time, both the formed element and the coating material will shrink.

It is very difficult to make coincident the shrinkage profiles of the formed element and the coating material. Therefore, firm interface combination between the formed element and the coating material is difficult to attain unless the coating material is melted. Once the coating material is melted, however, it would flag from the formed element, have no uniform thickness and erode the formed element. The melting of the coating material would inevitably cause the same to be structurally porous and apparently flagging after cooling.

A further feature of the present invention is that the formed element may be prefired at a suitable low temperature thereby to be shrunken 10 to 25% in volume. This serves to cause the coating material to be firmly pressed to the prefired form element all the time during a firing thereby to preclude an undesirable incomplete contact between the coating material and the formed element which might otherwise occur due to the difference in firing shrinkage profile between the coating material and the formed element. The firm pressing of the coating material to the prefired formed element facilitates the reaction of the formed element with the coating material and as a result brings about better joint therebetween.

A still further feature of the present invention is that the starting material of the insulating coating may be calcined at a suitable low temperature into an intermediate product, i.e. synthetic material, which will later be coated on the formed element. The calcining of the starting material serves to control the composition of and the products included in the final insulating coating. The final products included in the insulating coating are zinc antimony oxide ($Zn_{7/3}Sb_{2/3}O_4$) of a spinel structure and zinc orthosilicate ($Zn_2SiO_4$). If the zinc antimony oxide is produced much more in amount than the zinc orthosilicate, it would promptly grow in crystal into relatively large masses. Thus the insulating coating has a mechanically weak structure and acts to shorten the path of possible sparks produced between the resistance element and the insulating coating. However, according to the present invention, the insulating coating has a structure in which fine zinc antimony oxide and zinc orthosilicate grains having substantially the same size are densely packed thereby to serve to lengthen the paths of the sparks and to suppress the separation of the insulating coating from the resistance element due to the sparks.

DESCRIPTION OF THE DRAWINGS

These and other objects and features of the present invention will become more apparent after a perusal of the following specification taken in connection with the accompany drawings in which.

DESCRIPTION OF THE PREFERRED EMBODIMENT AND METHOD

Like numerals, with or without a subscript such as "*a*," refer to the like parts throughout the several views.

Figure 1:
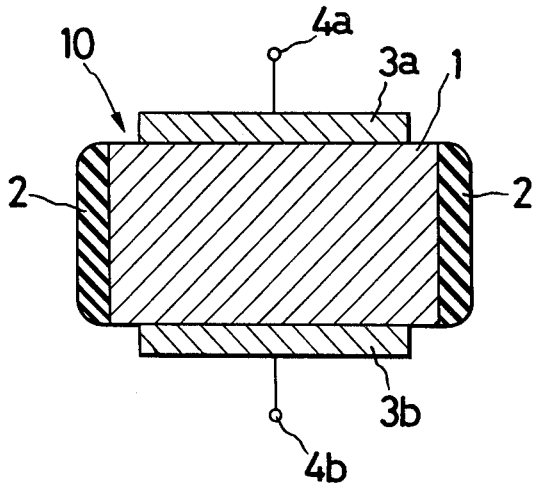
FIG. 1 is a schematic sectional view of a first embodiment of the non-linear resistor according to the present invention.

Referring to FIG. 1 of the drawings, there is shown the first embodiment of the non-linear voltage-dependent resistor according to the present invention, generally indicated at 10. The resistor includes a resistance element 1 having a good non-linear resistance and a high dielectric constant. The resistor also includes an inorganic electrically insulting coating 2 formed on the side surface of the resistance element 1, electrode plates 3*a* and 3*b* respectively attached to each end of the element 1 and electrode terminals 4*a* and 4*b* leading from the plates. This particular embodiment intends to produce a transitional area providing firm joint between the resistance element and the insulating coating thereon. This also intends to make the insulating coating of densely packed fine constituent grains and to prevent an organic binder-free coating, which will finally become the insulating coating, from being melted during a firing stage of the manufacturing process. In order to attain these purposes, the starting material of the insulating coating includes ZnO compounds.

A resistor having the above structure can be produced as follows. A quantity (for example, 91 weight %) of powdered ZnO is fully mixed with a second predetermined quantity (for example, a total of 9 weight %) of ingredient materials $Sb_2O_3$, $Co_2O_3$ (cobalt oxide), $Cr_2O_3$ (chromium oxide), $MnO_2$ (manganese dioxide) and a small percentage of additives. The mixture thus obtained is then pressed in a mold into a formed element having a desired shape, for example, a disc of 40 mm in diameter and 30 mm in thickness. The formed element will finally become the resistance element 1.

The formed element thus obtained is then coated on its side surface with a coating paste, which will finally become the electrically insulating coating 2, comprising a composition of 2.0 mole ratio of $ZnO/SiO_2$, 3 mole % of $Bi_2O_3$, and 8 mole % of $Sb_2O_3$ and a suitable organic binder (for example, ethylcellulose, butyl carbitol, etc.) by means of a brush, roller, spray, etc. and then heated at a temperature of about 600° C to remove the organic binder. The formed element with the organic binder-free coating thereon is then fired at a temperature of 1,250° C for 5 hours to form the resistor 10.

Analysis of the insulating coating of the resistor, thus obtained, by X-ray diffraction method has shown that the coating includes zinc orthosilicate ($Zn_2SiO_4$) compounds (main product) produced by the reaction of the ZnO with the $SiO_2$ included in the coating paste and $Zn_{7/3}Sb_{2/3}O_4$ compounds having a spinel structure and produced by the reaction of the $Sb_2O_3$ with the ZnO in the coating paste, with no low-resistivity zinc oxide remaining in the insulating coating. The $Zn_2SiO_4$ and the $Zn_{7/3}$ $Sb_{2/3}O_4$ have high electric resistances, respectively. For example, the former has a resistivity of $10^{13}\Omega$-cm.

Figure 2:
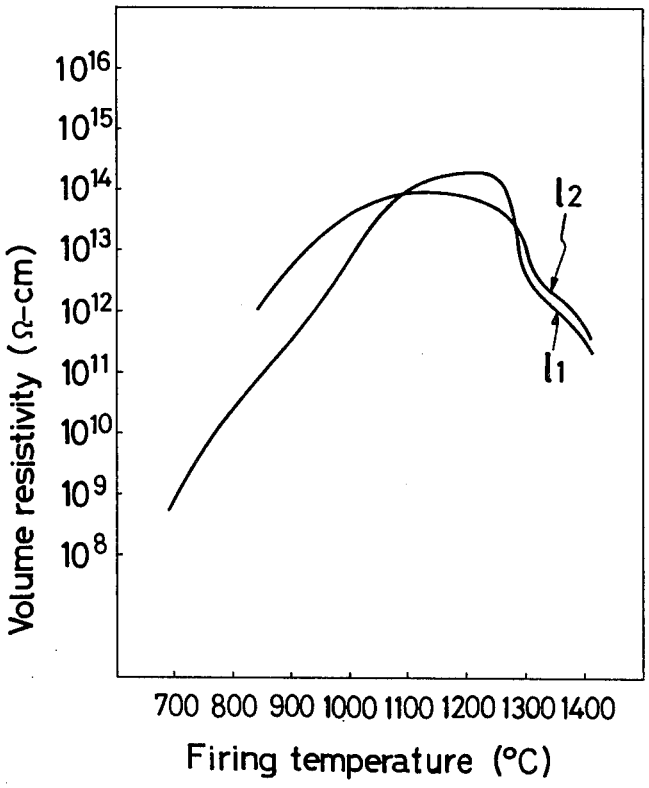
FIG. 2 shows characteristic curves of the relations between the firing temperatures and the volume resistivities of the inorganic insulating coatings in the non-linear resistors of the present invention obtained at the firing temperature.

Thus, the coating has a high volume resistivity of $6\times10^{13}\Omega$-cm and a surface resistivity of $7.6\times10^{13}\Omega$. $L_1$ in FIG. 2 is the curve showing the relationship between the firing temperature for obtaining and the volume resistivity of the insulating coating formed on the resistance element, the starting material of the coating being a mixture of 2.0 mole ratio of $ZnO/SiO_2$, and 1.5 mole % of $Bi_2O_3$. Curve $l_2$ shows a similar relationship of the insulating coating in the resistor according to the present invention. Its starting material includes a mixture of a 2.0 mole ratio of $ZnO/SiO_2$, 3 mole % of $Bi_2O_3$, and 8 mole % of $Sb_2O_3$. As is obvious from FIG. 2, with a certain quantity of antimony trioxide added, the insulating coating obtained by firing the organic binder-free coating at a temperature of from 1,000 ° to 1,300 ° C has only a small change in volume resistivity and therefore a substantially stable high resistivity (see the curves $l_1$ and $l_2$ in FIG. 2).

Figure 12:
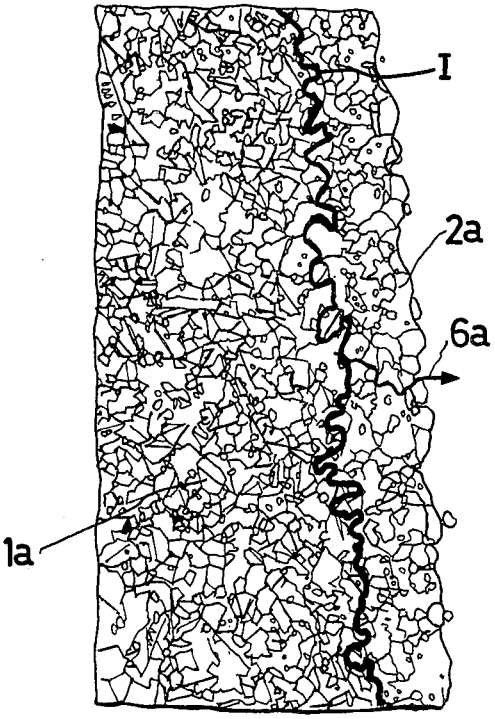

During the firing process, the ZnO compounds existing at the interface between the formed element and the organic binder-free coating react with each other by the medium of melted $Bi_2O_3$ compounds included in the organic binder-free coating thereby to form in solid phase reaction a transitional interface area, as shown by a solid line I in FIG. 12, firmly joining the coating to the formed element. Then, $Zn^{2+}$ ions included in the formed element diffuse through the interface area into the coating thereby to give to the interface area a concentration gradient changing continuously from the composition concentration of one of the formed element and the organic binder-free coating to that of the other. During the firing process, the organic binder-free coating reacts by itself to form the electrically insulating coating 2 of high electric resistance as well as of high melting point, thereby preventing the organic binder-free coating from being melted, porous and void.

The $Sb_2O_3$ ingredient in the organic binder-free coating acts to suppress the crystal growth of zinc orthosilicate during firing and the resultant electrically insulating coating, therefore, has a composition structure wherein the constituent grains are very fine and closely packed, and has a large mechanical strength.

The starting materials of the insulating coating used in the present invention are composed of a mixture of ZnO, $SiO_2$, $Bi_2O_3$ and $Sb_2O_3$, as obtained by adding $Sb_2O_3$ to a mixture of ZnO, $SiO_2$ and $Bi_2O_3$ which may also be used as a starting material of the insulating coating. The $Bi_2O_3$ (having a resistivity of $10^8\Omega$-cm) serves as a reaction accelerator and the $Sb_2O_3$, which is the same ingredients as is used in the formed element, permits the organic binder-free coating to tolerate a wide range of firing temperatures of from 1,000 ° to 1,400° C in order to get a resistance higher than $10^{11}\Omega$-cm as shown by curve $l_2$ in FIG. 2. In this respect, the insulating coating can be used as a high electric resistance if its resistivity is not less than $10^{11}\Omega$-cm. The volume shrinkage of the organic binder-free coating thus obtained is substantially constant, for example about 20%, with percentage content of $Sb_2O_3$ as shown by curve $l_3$ in FIG. 3. Since the formed element can be shrunken about 20% in volume due to the firing, both the formed element and the organic binder-free coating thereon will be equal to each other in volume shrinkage, thereby bringing about firm joint therebetween.

Figure 3:
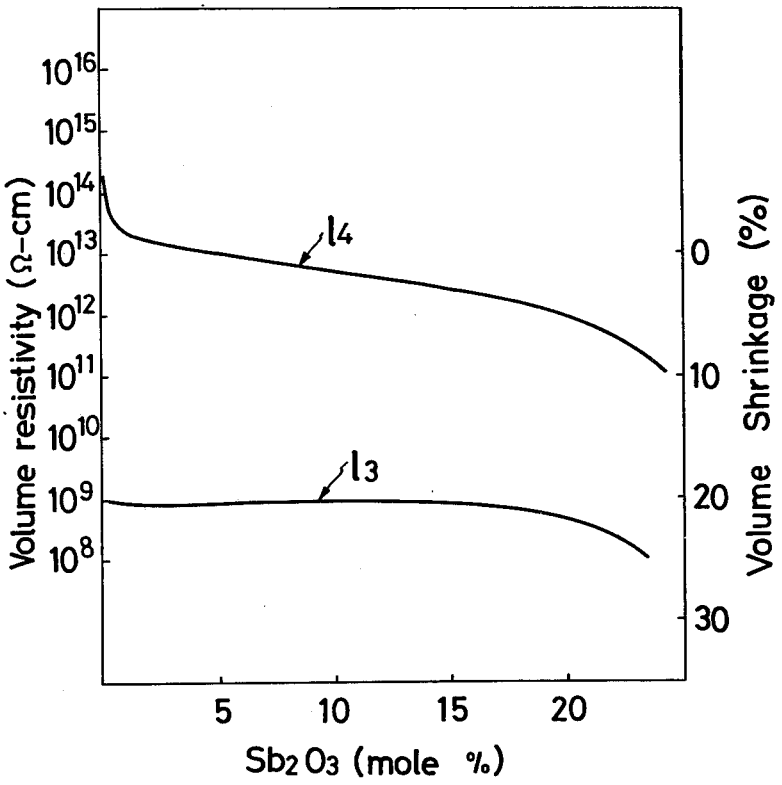
FIG. 3 shows characteristic curves of the relationship between the quantity of $Sb_2O_3$ included in the insulating coating in the non-linear resistor according to the invention, the volume resistivity of and the volume shrinkage of the insulating coating thereof.

A curve $l_4$ in FIG. 3 shows the relation between volume resistivity of the insulating coating finally formed on the resistance element 1 of the resistor according to the present invention and quantity of $Sb_2O_3$ (mole %) included in the insulating coating, the insulating coating being obtained by firing at 1,250° C for 5 hours the organic binder-free coating of 2.0 mole ratio of ZnO/-$SiO_2$, and 3 mole % of $Bi_2O_3$ coated on the formed element. The curve $l_3$ shows the relationship between volume shrinkage percent of the organic binder-free coating due to the firing and the same quantity of the $Sb_2O_3$ included in the same organic binder-free coating.

Since the organic binder-free coating can be made equal to the formed element in volume shrinkage percent by firing, good joint can be attained between the resultant resistance element 1 and the resultant insulating coating 2 thereon. On the other hand, the insulating coating is similar to the resistance element in coefficient of thermal expansion and therefore there will occur neither cracks in the insulating coating nor separation of the coating from the resistance element which might otherwise occur owing to a sharp rise in temperature of the resistor caused by an impulse current flowing through the resistor. It thus has high resistances to thermal and mechanical shock and has a high function reliability. There is no possibility that the insulating coating 2 will be deteriorated with time because it is made of inorganic material.

Attention is then drawn to the insulation characteristic of the resistor according to the present invention In a withstand arc test according to ASTM method, the resistor according to the present invention satisfactorily withstood for more than 420 sec, while the comparable prior art resistor including its coating of epoxy resin did so for 120 to 180 sec. A withstand corona test by applying an energy of 100 pulses per second, each pulse consisting of a charge of $10^{-9}$ coulombs, proves that the resistor according to the present invention has a withstand corona life longer than 2 years: in fact, it has satisfactorily withstood for more than 2 years since the starting of the test, while the prior art resistor having the epoxy resin insulating coating satisfactorily withstood for 2,000 hours.

As for a deterioration factor defined as the $V_{1.0mA}$ change percent $= (V_{1.0mA} - V'_{1.0mA})/V_{1.0mA}$ where $V_{1.0mA}$ is the voltage applied across a resistor and necessary for causing a 1.0OmA current through the resistor before an impulse currrent having a crest value of 30KA (current wave form 4×10us) is applied to the resistor, and $V'_{1.0mA}$ is the voltage applied across the resistor and necessary for causing a current of 1.0mA through the resistor after the same voltage has been applied to the resistor, the resistor according to the present invention (having the resistance element of 32 mm in diameter and 25 mm in thickness and the insulating coating of 0.1 mm in radial thickness) has a $V_{1.0mA}$ change percent of minus (−) (0.5 to 1.5)% while the prior art resistor including the epoxy resin insulating coating has a $V_{1.0mA}$ change percent of minus (−) (2 to 5)%. The resistor according to the present invention satisfactorily twice withstood a impulse current whose crest value is 50KA while a comparable resistor of the prior art twice withstood a impulse current whose crest value was 40KA.

Although the present invention has been described with respect to the resistor produced at a firing temperature of 1,250° C, the present invention is not limited to that particular embodiment. The present invention includes non-linear resistors produced at a firing temperature of from 1,000° to 1,400° C, perferably 1,000° to 1,300° C, which can also provide sufficiently high volume resistivities, as seen from the curve $l_2$ in FIG. 2.

Incomplete firing of the formed element would occur at a temperature lower than 1,000° C, while, at a temperature higher than 1,400° C, the organic binder-free coating would melt, flag from a lower end of the formed element and therefore have no uniform thickness. This would make the resultant insulating coating porous. In an extreme case, the melted orgnaic binder-free coating would erode and deform the formed element.

Although, in this particular embodiment, the starting material of the insulating coating 2 has been described as including a mixture having a composition of 2 mole ratio of $ZnO/SiO_2$, 3 mole % of $Bi_2O_3$ and 8 mole % of $Sb_2O_3$, the present invention is not limited to this particular embodiment. The starting material of the insulating coating may be a mixture having a composition ratio of 4 to 0.2 mole ratio of $ZnO/SiO_2$, 0.3 to 10 mole % of $Bi_2O_3$ and 0.5 to 20 mole % of $Sb_2O_3$. In this instance, a firing temperature in the range of from 1,000° to 1,400° C may be used.

Thus, according to the present invention, the non-linear resistor has a good non-linear voltage-current characteristic, a structure of fine and closely packed grains, and a high mechanical strength and electric resistance. Since the resistor according to the present invention has good joint between the resistance element and the insulating coating formed and since the insulating coating is made of inorganic compounds and has a structure where fine constituent grains are closely packed, it is greatly improved in high impulse current withstand, corona-proof characteristic, arc-proof characteristic and deterioration factor, respectively, compared with those of the prior art resistor including an epoxy resin insulating coating.

Figure 4:
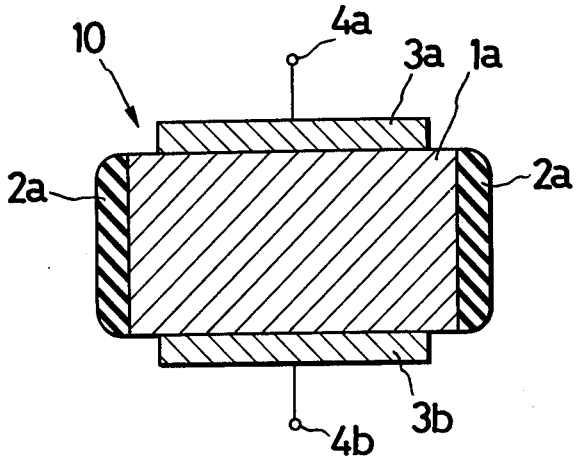
FIG. 4 is a sectional view of a second embodiment of the non-linear resistor according to the invention.

The second embodiment of the non-linear resistor of the invention, shown in FIGS. 4, intends to prevent the separation of the organic binder-free coating of the resistor from the resistance element which might occur due to the difference in firing shrinkage profile between the formed element and the organic binder-free coating formed thereon. In order to attain this purpose, the formed element is to be prefired, as described hereinafter in more detail. The resistor 10 includes a resistance element 1*a* having a good non-linearity and a high dielectric constant (non-linear index $\alpha > 50$), and an electrically insulating coating 2*a*, whose main constituents are $Zn_{7/3}Sb_{2/3}O_4$ (of a spinel structure) and $Zn_2SiO_4$ (zinc orthosilicate), formed on the side surface of the resistance element 1*a*. Such resistor 10 can be produced as follows: the starting material of the insulating coating 2*a* is first prepared as a mixture of *p* mole % of ZnO ($1 < p \leqq 60$), *q* mole % of $SiO_2$ ($30 \leqq q \leqq 80$), *r* mole % of $Sb_2O_3$ ($5 \leqq r \leqq 30$), and *s* mole % of $Bi_2O_3$ ($3 \leqq s \leqq 10$) which are respectively exactly weighed, as desired, on condition that $p + q + r + s = 100$. The mixture, then, is fully mixed in a ball mill, filled with an organic binder such as ethylcellulose, and with a solvent such as n-butyl acetate, cellosolve acetate etc., and kneaded in a mill to obtain a coating paste which will finally become the insulating coating 2*a*. A formed element, such as described above, which includes zinc oxide as one ingredient and which will be later finished as the resistance element 1*a* is subjected to a prefiring at a temperature of 800° to 1,200° C to obtain a prefired formed element which has been shrunken 10 to 25% in volume owing to the prefiring. The prefired element thus obtained is then coated on its side surface with the above coating paste by means of a brush, spray or roll. This prefired formed element with the coated paste thereon is then heated at about 900° C to remove the organic binder therefrom. Next, this prefired element with the organic binder-free coating is fired at a temperature of from 1,000° to 1,400° C.

As a result, the resistor having the insulating coating 2*a*, whose main constituents are $Zn_{7/3}Sb_{2/3}O_4$ (having a spinel structure) and $Zn_2SiO_4$ (zinc orthosilicate) formed on the resistance element 1*a* is obtained.

During firing of the prefired element with the organic binder-free coating at the temperature of from 1,000° to 1,400° C, the organic binder-free coating is subjected to the following reaction:

$$7/3\ ZnO + 1/3\ Sb_2O_3 + 1/3\ O_2 \rightarrow Zn_{7/3}Sb_{2/3}O_4$$
$$2ZnO + SiO_2 \rightarrow Zn_2SiO_4\ ,$$

In this instance, first, ZnO, $SiO_2$ and $Sb_2O_3$ compounds in the organic binder-free coating reacts and produce the products shown in the above expressions by the medium of melted $Bi_2O_3$. At the same time, $Zn^{2+}$ions diffusing out of the prefired formed element react with the intermediate reaction products produced in the organic binder-free coating to produce a firm chemical combination between the prefired formed element and the organic binder-free coating.

Figure 5:
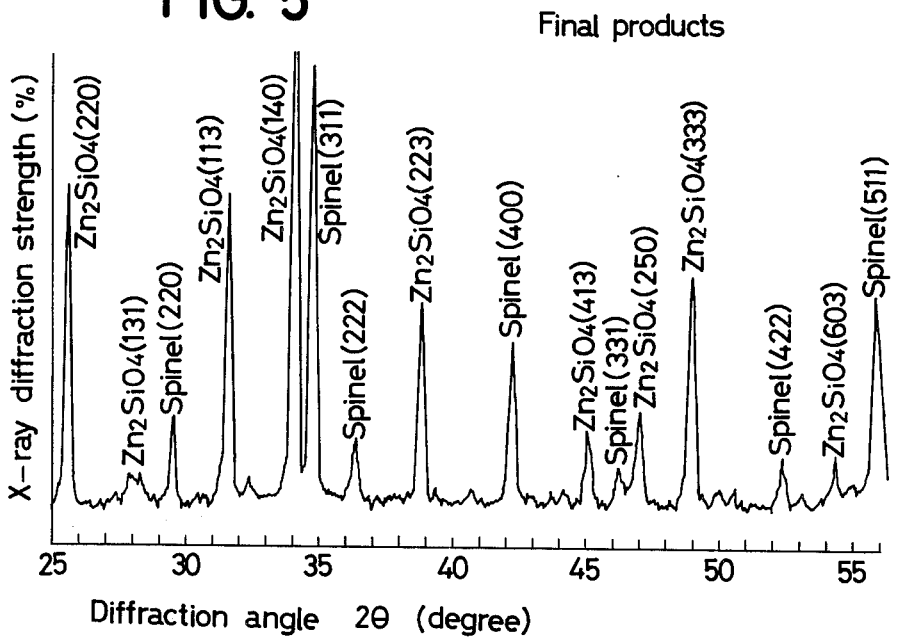
FIG. 5 is the X-ray diffraction profile of the final products included in the inorganic insulating coating of the second embodiment of the non-linear resistor according to the present invention after firing.

As a result, the resistor has a disc-type resistance element 1*a* of 33 mm in diameter and 30 mm in thickness and the insulating coating 2*a* of 0.1 mm in radial thickness. Analysis of the insulating coating 2*a* by X-ray diffraction method shows that the insulating coating includes the final products $Zn_{7/3}Sb_{2/3}O_4$ and $Zn_2SiO_4$ as seen in FIG. 5 wherein the "spinel" indicates the product $Zn_{7/3}Sb_{2/3}O_4$ having a spinel structure and the bracketed digits after the respective indications of the products indicate corresponding Miller indices. Further, quantitative analysis proves that the coating includes about from 5 to 63 weight % of $Zn_{7/3}Sb_{2/3}O_4$ and about from 30 to 85 weight % of $Zn_2SiO_4$.

The composition of several kinds of starting materials of the insulating coating 2*a* and the characteristics of the resultant products from the materials are given in Table 1.

TABLE 1

| example No. | composition of starting material (mole %) ZnO | $Bi_2O_3$ | $Sb_2O_3$ | $SiO_2$ | surface resistivity | impulse current withstand 30KA | 40KA | 50KA | 60KA | 70KA | $V_{1.0mA}$ change percent (50KA) |
|---|---|---|---|---|---|---|---|---|---|---|---|
| 1 | — | 8.02 | 11.98 | 80.00 | $3.1 \times 10^{13}\ \Omega$ | 100% | 100% | 62% | 33% | 0% | < 4.1% |
| 2 | 14.56 | 6.83 | 17.07 | 61.54 | $3.3 \times 10^{13}$ | 100 | 100 | 73 | 37 | 2 | < 3.9 |
| 3 | 33.85 | 5.29 | 13.21 | 47.65 | $4.0 \times 10^{13}$ | 100 | 100 | 82 | 51 | 11 | < 2.0 |
| 4 | 46.03 | 4.31 | 10.79 | 38.86 | $3.7 \times 10^{13}$ | 100 | 100 | 75 | 39 | 4 | < 3.2 |
| 5 | 56.63 | 3.02 | 10.05 | 30.30 | $2.1 \times 10^{13}$ | 100 | 100 | 64 | 32 | 0 | < 3.9 |

Numerical values indicated as a % in the impulse current withstand column show the number out a total of 100 resistor samples that have satisfactorily withstood a high impulse current applying test. 30KA, 40KA, 50KA etc. mean the crest values of 4 x10 $\mu$s impulse currents used in the test. $V_{1.0mA}$ change percent (50KA) means $V_{1.0mA}$ change percent by application of a 50KA crest value impulse current. These equally applies to TABLES 2 to 6 which will appear hereinafter.

With more than 60 mole % of ZnO being included in each of the starting materials of the insulating coatings listed in the Table, the resultant insulating coating would include an unreacted quantity of ZnO and have a low electric resistance even after firing. Inclusion of an excessive quantity of $SiO_2$ in each of the starting materials of the insulating coatings would result in an insufficient firing. Inclusion of an excessive quantity of either $Sb_2O_3$ or $Bi_2O_3$ in each of the starting materials of the insulating coating would cause a lowering of the melting point of a resultant organic binder-free coating and a melting of and a resultant flagging of the organic binder-free coating thereby to make the resultant electrically insulating coating 2*a* unequal in thickness and make the same porous. In an extreme case, the melted organic binder-free coating would erode and deform the prefired formed element.

Figure 6:
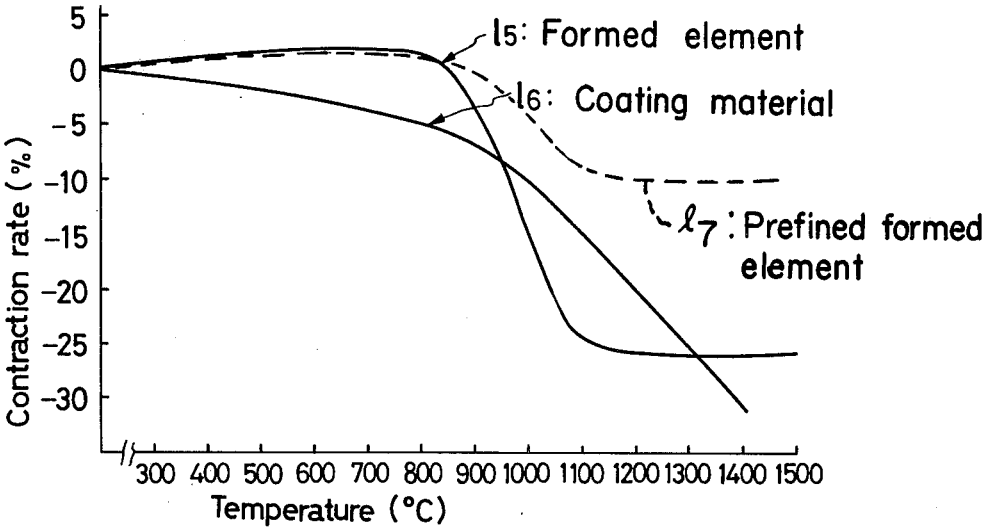
FIG. 6 shows the relationship between firing temperature and volume shrinkage of each of the formed element, the organic binder-free coating, and the formed element which has prefired at 900° C.

The reason why the formed element which will finally become the resistance element 1*a* is subjected to the prefiring at the temperature of from 800 to 1,200° C is as follows: $l_5$, $l_6$ and $l_7$ in FIG. 6 are respectively curves showing firing volume shrinkage of the formed element, the organic binder-free coating and the prefired formed element which is obtained by prefiring the formed element at 900° C and shrinking it about 15% in volume. The axis of abscissa of FIG. 6 shows the firing temperature and the axis of ordinate shows volume shrinkage percent.

If the formed element with the organic binder free-coating thereon is fired at a temperature of from 850° to 1,100° C, the formed element will shrink sharply, i.e. about 25% in volume. Therefore, it is necessary that the organic binder-free coating should sufficiently react with the formed element below a temperature at which curves $l_5$ and $l_6$ intersect each other to bring about a sufficiently firm chemical combination between the formed element and the organic binder-free coating.

As is seen from FIG. 6, the curves $l_5$ and $l_6$ intersect at about 900° C. At a temperature below about 900° C, the organic binder-free coating is merely deposited on the formed body. The formed element and the organic binder-free coating do not react promptly with each other unless the reaction temperature is over about 850° C. If the formed element and the organic binder-free coating do not sufficiently react with each other at a temperature between about 850° C and about 900° C, the organic binder-free coating would separate from the formed element because the coating shrinks in volume less than the formed element at a temperature higher than 900° C. At a further higher temperature, the organic binder-free coating itself would melt by the action of $Bi_2O_3$ included therein and adhere flaggingly to the side surface of the resultant resistance element. Thus, the joint between the resultant resistance element and the insulating coating would not so good and the resultant insulating coating would be roughly porous. The reason for this is that the formed element shinks sharply and greatly at a temperature of from 850° to 1,100° C. In order to avoid this unfavorable occurrence, it is necessary that the formed element should be prefired so that it react fully with the organic binder-free coating thereon.

Use of the formed element shrunken about 10 to about 25% (in this particular embodiment 15%) in volume by a prefiring at about 900° C will allow the formed element to less shrink in volume at a next firing over 850° C. Thus, at a temperature higher than 850° C and where the formed element and the organic binder-free coating react sufficiently with each other, the organic binder-free coating will remain adhering firmly to the formed element, as noticed from the curves $l_5$ and $l_7$ in FIG. 6. In this instance, the shrinkage of the prefired formed element gradually proceeds and the reaction between the prefired formed element and the organic binder-free coating is well effected: first, a firm chemical combination is produced at the interface between the prefired formed element and the organic binder-free coating, and secondly, numerous $Zn^{++}$ diffuse from the prefired formed element into the coating, thereby providing a sintered electrically insulating coating having a composition structure of densely packed fine grains.

Figure 7:
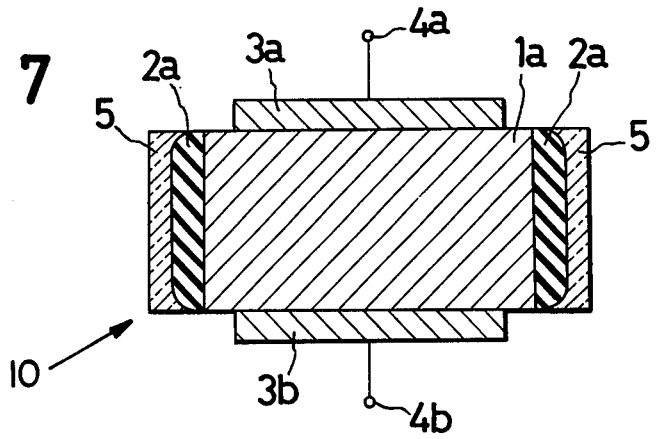
FIG. 7 is a schematic sectional view of a third embodiment of the resistor according to the present invention.

FIG. 7 shows a third embodiment of the non-linear resistor according to the present invention. The resistor 10 is composed of resistance element 1a having a non-linear resistance, such as described above, an electrically insulating coating 2a, such as also described above, whose main constituents are $Zn_{7/3}Sb_{2/3}O_4$ (having a spinel structure) and $Zn_2$ $SiO_4$ (zinc orthosilicate), formed on the side surface of the resistance element 1a and a glass layer 5 formed on the outer surface of the coating 2a. The glass layer is used in order to prevent the occurrence of a flashover on the resistor due to possible pinholes produced in the insulating coating and in order to compensate for an unequalness in the thickness of the insulating coating.

Such resistor is produced as follows: A mixture having a 20/1 weight ratio of glass frit/organic binder where the glass frit is one passed through a 150-mesh sieve and the organic binder is one such as ethylcellulose or butyl calbitol. This mixture is fully kneaded with a solvent such as cellosolve acetate to obtain a paste. Such paste was then stirred with a diluting solvent such as xylene, toluene, ethyl acetate etc. to obtain a coating slurry. A resistor such as shown in FIG. 4 is then coated on the outer side surface thereof (i.e. of the insulating coating 2a) with that slurry to a thickness or quantity of 15 mg/cm² by means of a brush, roll, spray, etc. The resistor thus obtained is heated at a temperature of from 200° to 380° C to remove the organic binder therefrom and then fired at a temperature of from 400° to 650° to obtain the glass layer 5 firmly fused to the outer surface of the insulating coating 2a.

Tables 2, 3 and 4 show several modifications of the third embodiment of the resistor according to the present invention and their performances. The coating quantity of the glass frit and organic binder mixture on the side surface of the resistor was 15 mg/cm² in the Tables 2, 3 and 4, but not less than 7 mg/cm² of coating quantity of the glass frit and organic binder mixture would suffice for the resistor, as shown in Table 5.

TABLE 2

| glass No. | coefficient of thermal expansion | fusing temperature | crystalline | impulse current withstand 40KA | 50KA | 60KA | 70KA | 80KA | $V_{1.0mA}$ change percent (50KA) |
|---|---|---|---|---|---|---|---|---|---|
| 1 | $7.1 \times 10^{-6}$ ° $C^{-1}$ | 630° C | crystallized | 100% | 100% | 91% | 62% | 34% | < 3.3% |
| 2 | $7.4 \times 10^{-6}$ | 600 | non-crystal | 100 | 100 | 73 | 43 | 5 | < 4.3 |
| 3 | $7.7 \times 10^{-6}$ | 560 | crystallized | 100 | 100 | 93 | 65 | 29 | < 3.8 |
| 4 | $7.8 \times 10^{-6}$ | 530 | non-crystal | 100 | 100 | 71 | 41 | 4 | < 4.5 |
| 5 | $8.4 \times 10^{-6}$ | 485 | crystallized | 100 | 100 | 83 | 57 | 18 | < 4.1 |
| 6 | $8.5 \times 10^{-6}$ | 450 | non-crystal | 100 | 100 | 70 | 38 | 2 | < 4.7 |
| | no glass layer | — | — | 100 | 62 | 33 | 0 | | < 10.1 |

In these particular examples, the starting material of the insulating coating of the resistor consists of 8.02 mole % of $Bi_2O_3$, 11.98 mole % of $Sb_2O_3$, and 80.00 mole % of $SiO_2$.

TABLE 3

| glass No. | coefficient of thermal expansion | fusing temperature | crystalline | impulse current withstand 40KA | 50KA | 60KA | 70KA | 80KA | $V_{1.0mA}$ change percent (50KA) |
|---|---|---|---|---|---|---|---|---|---|
| 1 | $7.1 \times 10^{-6}$ ° $C^{-1}$ | 630° C | crystallized | 100% | 100% | 100% | 89% | 61% | < 3.1% |
| 2 | $7.4 \times 10^{-6}$ | 600 | non-crystal | 100 | 100 | 98 | 73 | 45 | < 4.2 |
| 3 | $7.7 \times 10^{-6}$ | 560 | crystallized | 100 | 100 | 100 | 90 | 75 | < 2.9 |
| 4 | $7.8 \times 10^{-6}$ | 530 | non-crystal | 100 | 100 | 97 | 72 | 43 | < 4.3 |
| 5 | $8.4 \times 10^{-6}$ | 485 | crystallized | 100 | 100 | 99 | 85 | 58 | < 3.5 |
| 6 | $8.5 \times 10^{-6}$ | 450 | non-crystal | 100 | 100 | 90 | 69 | 40 | < 4.4 |
| | no glass layer | — | — | 100 | 82 | 51 | 11 | 2 | < 9.5 |

In these particular examples, the starting material of the insulating coating of the resistor consists of 33.85 mole % of ZnO, 5.29 mole % of $Bi_2O_3$, 13.21 mole % of $Sb_2O_3$ and 47.65 mole % of $SiO_2$.

TABLE 4

| glass No. | coefficient of thermal expansion | fusing temperature | crystalline | impulse current withstand 40KA | 50KA | 60KA | 70KA | 80KA | $V_{1.0mA}$ change percent (50KA) |
|---|---|---|---|---|---|---|---|---|---|
| 1 | $7.1 \times 10^{-6}$ ° $C^{-1}$ | 630° C | crystallized | 100% | 100% | 98% | 79% | 52% | < 3.2% |
| 2 | $7.4 \times 10^{-6}$ | 600 | non-crystal | 100 | 100 | 85 | 63 | 39 | < 4.4 |
| 3 | $7.7 \times 10^{-6}$ | 560 | crystallized | 100 | 100 | 97 | 83 | 71 | < 3.6 |
| 4 | $7.8 \times 10^{-6}$ | 530 | non-crystal | 100 | 100 | 83 | 62 | 37 | < 4.5 |
| 5 | $8.4 \times 10^{-6}$ | 485 | crystallized | 100 | 100 | 89 | 73 | 44 | < 3.9 |
| 6 | $8.5 \times 10^{-6}$ | 450 | non-crystal | 100 | 100 | 78 | 53 | 27 | < 4.8 |
| | no glass layer | — | — | 100 | 75 | 39 | 4 | 0 | < 10.1 |

In these particular examples, the starting material of the insulating coating of the resistor consists of 46.03 mole % of ZnO, 4.31 mole % of $Bi_2O_3$, 10.79 mole % of $Sb_2O_3$, and 38.86 mole % of $SiO_2$.

TABLE 5

| coating quantity ($mg/cm^2$) | glass No. | impulse current withstand 40KA | 50KA | 60KA | 70KA | 80KA |
|---|---|---|---|---|---|---|
| no glass | — | 100% | 62% | 32% | 0% | % |
| 3 $mg/cm^2$ | 1 | 100 | 67 | 39 | 12 | 0 |
| | 4 | 100 | 63 | 36 | 8 | 0 |
| | 5 | 100 | 65 | 38 | 9 | 0 |
| 5 $mg/cm^2$ | 1 | 100 | 88 | 57 | 26 | 11 |
| | 4 | 100 | 81 | 49 | 15 | 3 |
| | 5 | 100 | 87 | 52 | 22 | 7 |
| 7 $mg/cm^2$ | 1 | 100 | 100 | 68 | 43 | 21 |
| | 4 | 100 | 100 | 56 | 29 | 8 |
| | 5 | 100 | 100 | 62 | 25 | 13 |
| 10 $mg/cm^2$ | 1 | 100 | 100 | 87 | 53 | 25 |
| | 4 | 100 | 100 | 65 | 37 | 10 |
| | 5 | 100 | 100 | 83 | 42 | 21 |
| 15 $mg/cm^2$ | 1 | 100 | 100 | 94 | 62 | 34 |
| | 4 | 100 | 100 | 71 | 41 | 4 |
| | 5 | 100 | 100 | 83 | 57 | 18 |
| 30 $mg/cm^2$ | 1 | 100 | 100 | 100 | 85 | 52 |
| | 4 | 100 | 100 | 82 | 57 | 31 |
| | 5 | 100 | 100 | 89 | 62 | 47 |
| 70 $mg/cm^2$ | 1 | 100 | 100 | 93 | 60 | 31 |
| | 4 | 100 | 100 | 72 | 49 | 19 |
| | 5 | 100 | 100 | 83 | 58 | 23 |

1)In these particular examples, the starting material of the insulating coating of the resistor consists of 8.02 mole % of $Bi_2O_3$, 11.98 mole % of $Sb_2O_3$, and 80.00 mole % of $SiO_2$.
2)Glass No. 1: crystallized glass fused at 630° C As the glass frit which will finally become the glass layer 5, a low melting point, preferably crystallizable, glass, which can be fused to the insulating coating 2a at a temperature of from 400° to 650° C and which has a coefficient of thermal expansion of (6.8 to 8.5) × $10^{-6}$/°C, can be used, as is obvious from the Tables 2 to 4.

With only the insulating coating 2a being formed on the resistance element of the resistor, there is a likelihood that the insulaing coating will be unequal in thickness as well as have pinholes formed therein.

An additional provision of a glass layer such as 5 on the surface of the insulating coating 2a has served greatly to increase the ability to withstand a high impulse current, as shown in Table 2 to 4, and results in no lack of uniformity of abilities to withstand a high impulse current, to improve the change percent of $V_{1.0mA}$ between before and after application of an impulse current whose crest value is 50KA, as shown in the Table 2, and to prevent moisture from entering the insulating coating 2a, thereby giving an improved damp-proof property.

Figure 8:
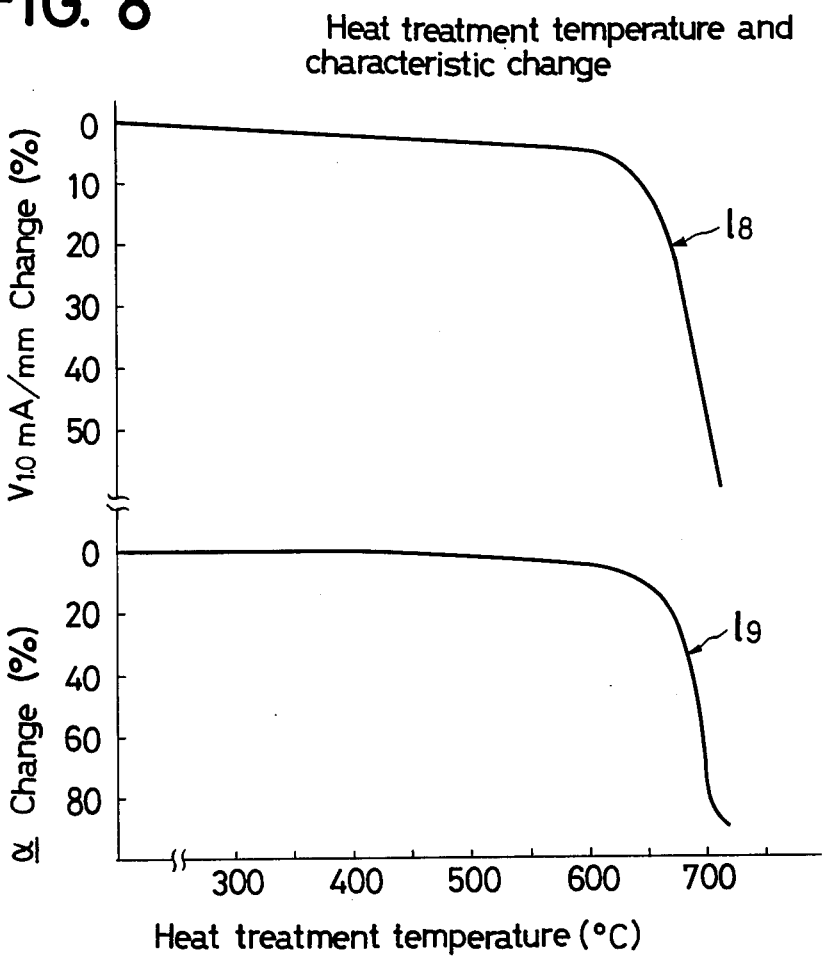
FIG. 8 shows a graph of heat treatment temperature of the non-linear resistor according to the present invention versus resultant characteristics thereof.

FIG. 8 shows the relationship between the heat treatment temperature, the non-linear index $\alpha$ change percent and the $V_{1.0mA}$/mm change percent on the non-linear resistor according to the present invention where the $V_{1.0mA}$/mm means the voltage necessary to make a current of 1.0mA flow through a unit axial thickness (mm) of the resistance element. It will be seen from FIG. 8 that the characteristics of the resistor deteriorate over 650° C, as shown by curve $l_8$ and $l_9$. Therefore, the heat treatment temperature is preferably in the range of from 400° to 600° C which is identical with the firing temperature of the glass layer. In this connection, insufficient firing would occur below 400° C.

Application of a high impulse current to the resistor 10 will sharply raise the temperature of the resistor to cause a strain, owing to the difference between the coefficients of thermal expansion of the resistor and the glass layer, thereby bringing about the separation of the glass layer and cracks in the glass layer unless the glass layer has a coefficient of thermal expansion of (6.8 to 8.5) × $10^{-6}$/°C.

Provision of a glass layer such as 5 on the coating 2 of the resistor 10 as shown in the first embodiment also serves to increase the ability to withstand a high impulse current.

A fourth embodiment of the resistor according to the present invention is now described: it includes a resistance element, such as described above, having a non-linear resistance, and an electrically insulating coating including at least $Zn_{7/3}Sb_{2/3}O_4$ grains of a spinel structure as a main constituent and formed on the side surface of the resistance element. The resistor is similar in structure to that shown in FIG. 4. This embodiment intends to make firmer the joint between the formed element and the organic binder-free coating thereon. This particular embodiment also intends to impart the insulating coating a mechanically strong composition structure wherein the fine constituent grains, $Zn_{7/3}Sb_{2/3}O_4$ and/or $Zn_2SiO_4$ having substantially the same size, are very closely packed and wherein the ratio of an organic binder to a powered ingredient mixture in a unit volume of the insulating coating is low. Thus, the formation of voids at the interface between the formed element and the coating is prevented, which voids would allow sparks to be created on the resistor element of the resistor. The densely packing of the fine constituent grains in the insulating coating serves to prevent part, for example, a constituent grain, of the insulating coating from being blown off by sparks created as well as to lengthen the paths of the sparks in the insulating coating.

The fourth embodiment is produced as follows: first, $p$ mole % of ZnO ($1 < p \leqq 60$), $q$ mole % of $Bi_2O_3$ ($3 \leqq q \leqq 10$), $r$ mole % of $Sb_2O_3$ ($5 \leqq r \leqq 30$), and $s$ mole % of $SiO_2$ ($30 \leqq s \leqq 80$) are exactly weighed, as desired, mixed, calcined at a temperature of from 500° to 1,100° C for 2 hours to produce a synthetic material including $Zn_{7/3}Sb_{2/3}O_4$, $ZnSb_2O_6$, $Zn_2SiO_4$, and $SbBiO_4$ produced by the following reactions;

$$7/3\ ZnO + 1/3\ Sb_2O_3 + 1/3\ O_2 \rightarrow Zn_{7/3}Sb_{2/3}O_4$$
$$ZnO + Sb_2O_3 + O_2 \rightarrow ZnSb_2O_6$$
$$Bi_2O_3 + Sb_2O_3 + O_2 \rightarrow 2SbBiO_4$$
$$2ZnO + SiO_2 \rightarrow Zn_2SiO_4$$

Figure 9:
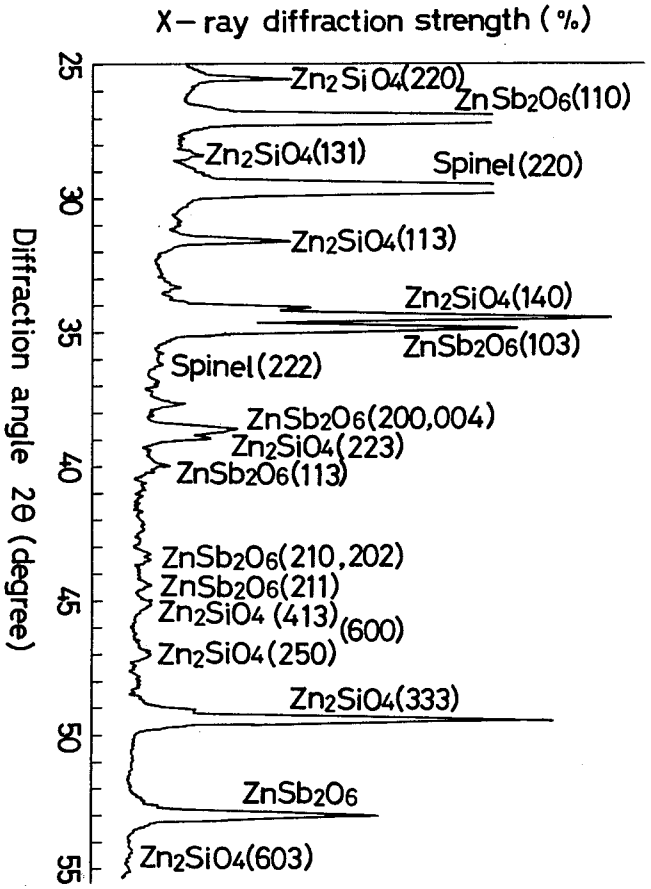
FIG. 9 is an X-ray diffraction profile of the reaction products included in the synthetic material obtained from the calcination of one of the starting materials of the insulating coating of a forth embodiment of the resistor according to the present invention.

In this connection, some of the above products can not be obtained depending upon the composition of the starting material and upon the calcining temperature. For example, FIG. 9 shows the case where $SbBiO_4$ is not obtained. The synthetic material thus obtained is ground in a ball mill and, then passed through a sieve having a 325-mesh size to obtain, for example, 25 different kinds of synthetic materials, as shown in Table 6. Each of these synthetic materials is weighed 15 weight part, then fully mixed and kneaded with 1 weight part of organic binder such as ethylcellulose, and with a suitable quantity of solvent (butyl carbitol, cellosolve acetate, etc.) to produce a paste. Such paste is then fully stirred with suitable quantities of a diluents such as toluene, xylene, etc. and a solvent such as n-butyl acetate, cellosolve acetate, etc. to obtain a coating slurry which will become the insulating coating after a later firing.

Secondly, a formed element such as is used for preparing the FIG. 7 embodiment and previously shrunken by 10 to 25% in volume by the prefiring, at a temperature of from 800° to 1,200° C for an hour, is coated on the side surface thereof with the coating slurry to a thickness or quantity of 20 mg/cm² by means of a roll, spray, brush, etc., then fired at a temperature of from 1,000° to 1,400° C for an hour to produce a compound including $Zn_{7/3}Sb_{2/3}O_4$, $Zn_2SiO_4$ and non-crystal substances in the resultant insulating coating and to fuse the insulating coating firmly to the side surface of the resistance element, thereby obtaining a non-linear resistor.

In this connection, with an insufficient quantity of ZnO being included in the starting material of the insulating material, the large quantity of $ZnSb_2O_6$ and $SbBiO_4$ produced would, during the firing, capture ions $Zn^{2+}$ moving out of the formed element and form spinel-type compounds before the reaction of $SiO_2$ with the ZnO. The $SiO_2$ would therefore fail to react with the ZnO and remain as the non-crystal substances mentioned above in the insulating coating.

Figures 10A, 10B:
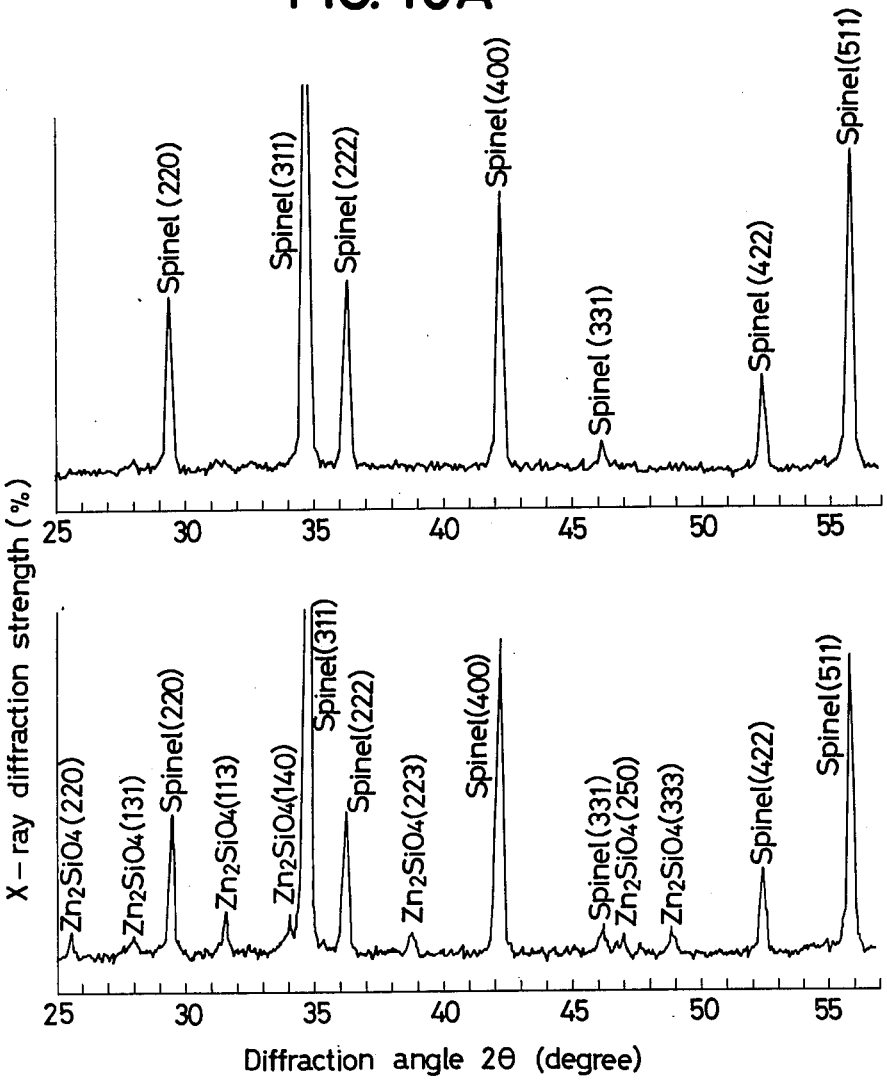
FIGS. 10A and B respectively show X-ray diffraction profiles of the products in the insulating coatings of two modifications of the forth embodiment of the non-linear resistor according to the present invention after the coatings have been subjected to calcining.

Several examples of starting materials of the insulating coating of the non-linear resistors are shown in Table 6. FIG. 9 illustrates the X-ray diffraction profile of a typical one of the synthetic materials. FIGS. 10 A and B illustrate X-Ray diffraction profiles of the products included in the insulating coatings 2a of the non-linear resistors which respectively include a relatively small amount of ZnO, as shown in Example No. 4 for example in Table 6 and a relatively large amount of ZnO, as shown in Example No. 21 for example in Table 6. In both FIGS. 10A and 10B, the resistance element is a disc of 33 mm in diameter and 30 mm in thickness, and with 0.7 g/cm² of a coating quantity of the synthetic material calcined at 700° C.

TABLE 6

| example No. | composition of starting material (mole %) ZnO | $Bi_2O_3$ | $Sb_2O_3$ | $SiO_2$ | calcining temperature | surface resistivity (Ω) | impulse current withstand 50KA | 60KA | $V_{1.0mA}$ change percent (50KA) |
|---|---|---|---|---|---|---|---|---|---|
| 1 | — | 8.0 | 12.0 | 80.00 | 500° C | $3.0 \times 10^{13}$ | 100% | 60% | 5.0% |
| 2 | — | 8.0 | 12.0 | 80.00 | 600 | $3.3 \times 10^{13}$ | 100 | 65 | 4.8 |
| 3 | 7.0 | 7.5 | 18.5 | 77.0 | 600 | $1.0 \times 10^{13}$ | 100 | 68 | 4.3 |
| 4 | 7.0 | 7.5 | 18.5 | 77.0 | 700 | $2.5 \times 10^{13}$ | 100 | 70 | 4.0 |
| 5 | 14.5 | 7.0 | 17.0 | 61.5 | 600 | $3.0 \times 10^{13}$ | 100 | 70 | 3.8 |
| 6 | 14.5 | 7.0 | 17.0 | 61.5 | 700 | $2.7 \times 10^{13}$ | 100 | 75 | 3.3 |
| 7 | 14.5 | 7.0 | 17.0 | 61.5 | 800 | $4.0 \times 10^{13}$ | 100 | 80 | 3.0 |
| 8 | 29.0 | 6.0 | 15.0 | 50.0 | 600 | $1.7 \times 10^{13}$ | 100 | 80 | 3.4 |
| 9 | 29.0 | 6.0 | 15.0 | 50.0 | 700 | $2.0 \times 10^{13}$ | 100 | 85 | 3.3 |
| 10 | 29.0 | 6.0 | 15.0 | 50.0 | 800 | $3.3 \times 10^{13}$ | 100 | 90 | 2.5 |
| 11 | 29.0 | 6.0 | 15.0 | 50.0 | 900 | $3.5 \times 10^{13}$ | 100 | 90 | 2.0 |
| 12 | 34.0 | 5.0 | 13.0 | 48.0 | 600° C | $2.5 \times 10^{13}$ | 100 | 100 | 1.5 |
| 13 | 34.0 | 5.0 | 13.0 | 48.0 | 700 | $3.0 \times 10^{13}$ | 100 | 100 | 1.3 |
| 14 | 34.0 | 5.0 | 13.0 | 48.0 | 800 | $3.5 \times 10^{13}$ | 100 | 100 | 1.2 |
| 15 | 34.0 | 5.0 | 13.0 | 48.0 | 900 | $4.0 \times 10^{13}$ | 100 | 100 | 1.2 |
| 16 | 46.0 | 4.0 | 11.0 | 39.0 | 600 | $2.0 \times 10^{13}$ | 100 | 80 | 2.8 |
| 17 | 46.0 | 4.0 | 11.0 | 39.0 | 700 | $2.3 \times 10^{13}$ | 100 | 90 | 2.5 |
| 18 | 46.0 | 4.0 | 11.0 | 39.0 | 800 | $3.0 \times 10^{13}$ | 100 | 100 | 1.9 |
| 19 | 46.0 | 4.0 | 11.0 | 39.0 | 900 | $3.3 \times 10^{13}$ | 100 | 90 | 2.3 |
| 20 | 46.0 | 4.0 | 11.0 | 39.0 | 1000 | $3.5 \times 10^{13}$ | 100 | 80 | 2.7 |
| 21 | 60.0 | 3.0 | 10.0 | 27.0 | 700 | $5.7 \times 10^{12}$ | 100 | 80 | 2.8 |
| 22 | 60.0 | 3.0 | 10.0 | 27.0 | 800 | $6.3 \times 10^{12}$ | 100 | 85 | 2.6 |
| 23 | 60.0 | 3.0 | 10.0 | 27.0 | 900 | $6.7 \times 10^{12}$ | 100 | 90 | 2.0 |
| 24 | 60.0 | 3.0 | 10.0 | 27.0 | 1000 | $7.0 \times 10^{12}$ | 100 | 80 | 2.8 |
| 25 | 60.0 | 3.0 | 10.0 | 27.0 | 1100 | $7.3 \times 10^{12}$ | 100 | 80 | 2.8 |

The number of resistor samples tested was 100 for each example.

If the starting material of the insulating coating is fine in grain, a relatively large quantity of organic binder would be needed to obtain a relatively thick organic binder-free coating on the unfired or prefired formed element. If the starting material is less fine in grain, a smaller quantity of binder would be needed. In the latter case, however, the starting material does not react well with the unfired or prefired formed element because of the less fine grains of the starting material, thereby resulting in poorer joint between the resultant resistance element and the resultant insulating coating thereon and obtaining a less fine-grained composition structure of the insulating coating. According to the present invention, the starting material of the insulating coating is calcined to form the apparently relatively large grains, each grain consisting of a group of fine grains. As a result, the organic binder used can be decreased in quantity and therefore coating of more than 70 mg/cm$^2$ of the synthetic material on the unfired or prefired formed element will cause no cracks in the resultant coating and no separation of the coating from the unfired or prefired formed element during the later heating. As the quantity of the organic binder included in a unit volume of the insulating coating is decreased, the quantity of the synthetic material included in a unit volume of the organic binder-free coating is relatively increased thereby to produce the insulating coating of densely packed fine grains during the firing. Since the powder grains of the organic binder-free coating are merely apparently large in size, they can react well with ions $Zn^{2+}$ diffusing from the unfired or prefired formed element during the firing thereby strengthening the joint between the resultant resistance element and the insulating coating thereon. Coating of more than 40 mg/cm$^2$ of the synthetic material on the unfired or prefired formed element can cause the resultant resistor to have an ability to withstand an impulse current having more than 70 KA in creest value though the starting material of the insulating coating may change over a considerably wide range of composition.

Figure 11:
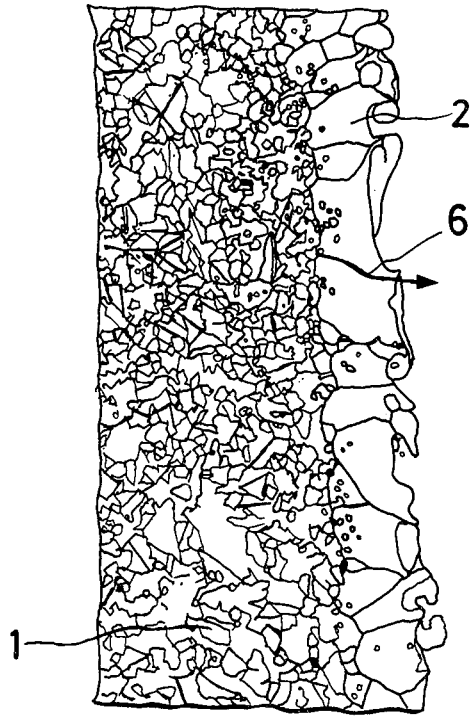
FIGS. 11 and 12 are respectively fragmentary views, on a large scale, of the resistors of the prior art and of the present invention for the purpose of explaining the operation of the resistors.
Figure 13:
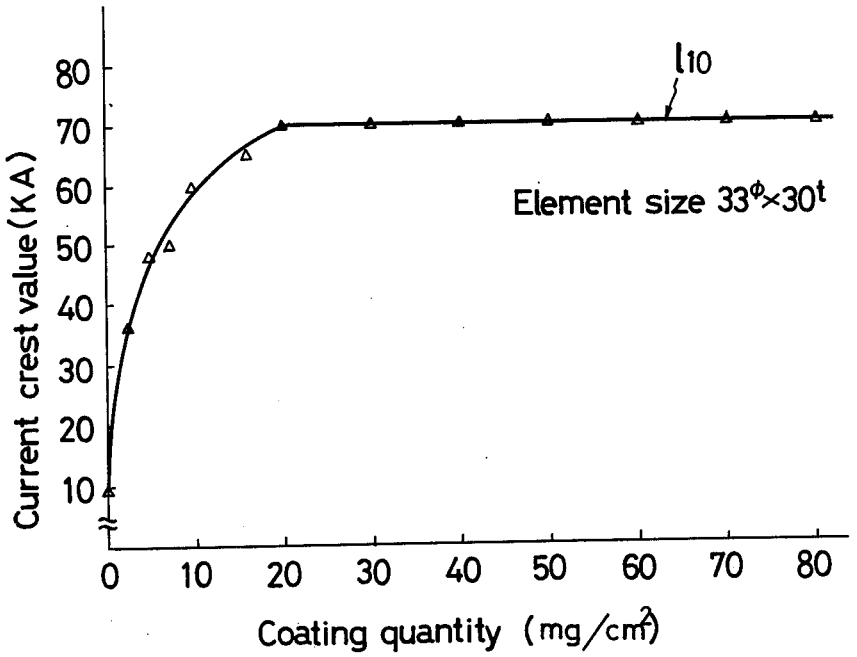
FIG. 13 shows the relationship between the high impulse current withstand of the resistor according to the present invention and the quantity of the resistor coating.

The calcining of the starting materials of the insulating coatings serves to give the resultant insulating coating an ability to withstand a impulse current having a crest value higher than 50 KA as shown at a curve $l_{10}$ in FIG. 13 in case of the insulating coatings being thin, for example, 7 mg/cm$^2$ or so thick. The curve $l_{10}$ in FIG. 13 is the one obtained from plotting the result of the measurement of the abilities of the resistors according to the present invention to withstand high impulse currents and the coating quantities of the insulating coating formed on the resultant resistance elements of the resistors. Each measured value shown at a triangle mark in FIG. 13 is the crest value of an impulse current which is applied to 50 equisized samples of the resistor having the same coating quantity that is changeable and which all the samples satisfactorily withstood, each sample including a resistance element having a final size of 33 mm in diameter and 30 mm in thickness. If the starting materials should fail to be primarily calcined and coated on the unfired or prefired formed element, the insulating coating would include a greater amount of $Zn_2SiO_4$ and less $Zn_{7/3}Sb_{2/3}O_4$ than otherwise because the production of $Zn_2SiO_4$ by the reaction of $Zn^{2+}$ ions, which will diffuse out of the unfired or prefired element, with $SiO_2$ in the organic binder-free coating, can not be controlled. With an especially thin insulating coating formed on the resistance element, $Zn_2SiO_4$ crystals will be encouraged to grow to large sizes by means of $Bi_2O_3$, thereby having a composition structure including relatively large grains such as are shown in FIG. 11. Accordingly, the path of a spark is undesirably shortened, as shown by the arrow 6 in FIG. 11. Of $Zn_{7/3}Sb_{2/3}O_4$, $ZnSb_2O_6$, $SbBiO_4$ and $Zn_2SiO_4$ produced by calcining the starting material, the $ZnSb_2O_6$ and $SbBiO_4$ first react with ions $Zn^{2+}$ diffusing from the unfired or prefired formed element to produce $Zn_{7/3}Sb_{2/3}O_4$, which are indicated in the following expressions:

$$6ZnO + ZnSb_2O_6 \rightarrow 3Zn_{7/3}Sb_{2/3}O_4$$
$$2/3SbBiO_4 + 7/3ZnO \rightarrow Zn_{7/3}Sb_{2/3}O_4$$

A microscope analysis shows that, the $SbBiO_4$ and $ZnSb_2O_6$ included in the synthetic material, as shown in FIG. 12, have acted to control the crystal creation and growth of the $ZnSiO_4$, and that the insulating coating has a composition structure wherein fine $Zn_{7/3}Sb_{2/3}O_4$ grains and $ZnSiO_4$ grains controlled to be substantially equal to the former in grain size have been packed more closely. Accordingly, the insulating coating thus obtained has a high mechanical strength and therefore the resistor will not be destroyed by a spark which may occur between the adjoining surfaces of the resistance element and the insulating coating thereon. Further, paths for sparks are lengthened, as shown by the arrow 6*a* in FIG. 12, which leads to suppression of a spark that would otherwise appear on the outer surface of the insulating coating, thereby increasing in the resistor an ability to withstand a high impulse current.

A curve $l_{10}$ shown in FIG. 13 illustrates the result of measurement of the high impulse current withstand (current crest value) of the resistor according to the present invention to the coating quantity of the insulating coating formed on the resistance element of the resistor. Each measured value shown at a triangle mark in FIG. 13 shows the crest value of an impulse current that all 50 equi-sized samples of the resistor having a corresponding coating quantity, withstood satisfactorily, each sample including a resistance element having a size of 33 mm in diameter and 30 mm in thickness.

It will be obvious that a formed element not subjected to a prefiring, as shown in he first embodiment, may be given a synthetic material such as shown in the fourth embodiment. Application of a glass layer such as shown in the third embodiment to a resistor such as the fourth embodiment will further increase the abilities of the resistors to withstand high impulse currents.

As is obvious from the above description, the non-linear resistor according to the present invention has the insulating coating including at least $Zn_{7/3}Sb_{2/3}O_4$ compounds of a spinel structure, although the insulating coating may further include $Zn_2SiO_4$ compunds. If the resistor has an inorganic electrically insulating coating including $Zn_{7/3}Sb_{2/3}O_4$ and $Zn_2SiO_4$ which form a composition structure of fine and densely packed grains and having a high electric insulation, it will result in obtaining the ability to satisfactorily withstand impulse currents, very useful as an arrester element. Use of the resistor as a gapless lightning arrester element has shown that the arrester element has a withstand life of more than 3 years under predetermined test conditions: the arrester element, in fact, has been safely and continuously given a predetermined test voltage for more than 3 years, while the comparable prior art resistor having an insulating coating including epoxy resin had a withstand life of 2,000 hours under application of the same test voltage. An accelerated life test ensures a 20-year withstand life for the resistor according to the present invention. The resistor according to the present invention suffered no damage by a corona discharge, in the order of 300 pulses per second (each pulse phain $10^{-9}$ coulombs), generated due to the accumulation of airborne dust and oil etc. on the insulating coating. The resistor according to the present invention has a high performance because of the good joint of the insulating coating to the resistance element, and because of the composition structure of the insulating coating wherein the fine constituent grains are closely packed.

Although several preferred embodiment of the present invention have been illustrated and described, it is believed evident to those skilled in the art that many changes and variations may be made without departing from the spirit and scope of this invention. Accordingly, this invention is to be considered as limited only by the following claims.

What is claimed is:

1. A non-linear voltage-dependent resistor comprising a non-linear resistance element having a good non-linearity and a high dielectric constant, and an inorganic electrically insulating coating formed on said resistance element, obtained by firing together at a temperature of from 1,000° to 1,400° C a formed element including zinc oxide (ZnO) and a coating material applied on the formed element, said coating material including a mixture of zinc oxide (ZnO), silicon dioxide ($SiO_2$), bismuth trioxide ($Bi_2O_3$) and antimony trioxide ($Sb_2O_3$).

2. A non-linear voltage-dependent resistor according to claim 1 wherein said mixture has a composition ratio of from 4 to 0.2 mole ratio of ZnO to $SiO_2$, 0.3 to 10 mole % of $Bi_2O_3$ and 0.5 to 20 mole % of $Sb_2O_3$.

3. A non-linear voltage-dependent resistor according to claim 1, wherein said resistance element and said insulating coating form a transitional area therebetween the concentration gradient of composition of which changes continuously from the composition of one of said resistance element and said insulating coating to that of the other, said area being produced by solid phase reaction of $Zn^2$ diffusing out of said formed element with said $Sb_2O_3$ and $SiO_2$ included in said coating material by the medium of said $Bi_2O_3$ at said firing.

4. A non-linear voltage-dependent resistor according to claim 2 wherein said insulating coating includes zinc orthosilicate ($Zn_2SiO_4$) produced by the reaction of said silicon dioxide ($SiO_2$) with said zinc oxide (ZnO), and zinc antimony oxide ($Zn_{7/3}Sb_{2/3}O_4$) having a spinel structure and produced by the reaction of said zinc oxide (ZnO) with said antimony trioxide ($Sb_2O_3$).

5. A non-linear voltage-dependent resistor according to claim 1 wherin said formed element is previously shrunken 10 to 25% in volume by a prefiring.

6. A non-linear voltage-dependent resistor according to claim 5 wherein the prefiring of said formed element is effected at a temperature of from 800° to 1,200° C.

7. A non-linear voltage-dependent resistor according to claim 5 wherein the starting material of said coating material has a composition ratio of $p$ mole % of zinc oxide where $1 \leqq p \leqq 60$, $q$ mole % of silicon dioxide ($SiO_2$) where $30 \leqq q \leqq 80$, $r$ mole % of antimony trioxide ($Sb_2O_3$) where $5 \leqq r \leqq 30$, $s$ mole % of bismuth oxide ($Bi_2O_3$) where $3 \leqq s \leqq 10$ so that $p+q+r+s=100$.

8. A non-linear voltage-dependent resistor according to claim 7, wherein said insulating coating includes zinc antimony oxide ($Zn_{7/3}Sb_{2/3}O_4$) having a spinel structure and zinc orthosilicate ($Zn_2SiO_4$).

9. A non-linear voltage-dependent resistor according to claim 7, wherein said insulating coating includes 5 to 63% of said zinc antimony oxide by weight and 30 to 85% of said zinc orthosilicate by weight.

10. A non-linear voltage-dependent resistor according to claim 1, further including a glass layer on the outer surface of said insulating coating, said glass layer having a coefficient of thermal expansion of (6.8 to 8.5) $\times 10^{-6}$/°C.

11. A non-linear voltage-dependent resistor according to claim 10, wherein said glass layer is one produced by fusing a glass coating applied onto said insulating coating at a temperature of 400° to 650° C, said glass coating being produced by kneading a mixture of a glass frit and an organic binder.

12. A non-linear voltage-dependent resistor according to claim 11, wherein said glass coating is applied at a coating thickness of at least 7 mg/cm$^2$.

13. A non-linear voltage-dependent resistor according to claim 1, wherein the starting material of said coating material is calcined at a temperature of from 500° to 1,100° C to enlarge the size of each of apparent grains constituting the calcined starting material of said coating material, each apparent grains including a group of smaller grains.

14. A non-linear voltage-dependent resistor according to claim 7, wherein the starting material of said coating material is calcined at a temperature of from 500° to 1,100° C to enlarge the size of each of apparent grains constituting the calcined starting material of said coating material, each apparent grain including a group of smaller grains.

15. A non-linear voltage-dependent resistor according to claim 13, wherein the calcined starting material of said coating material includes at least one compound selected from the group of $Zn_{7/3}Sb_{2/3}O_4$, $ZnSb_2O_6$, $SbBiO_4$ and $Zn_2SiO_4$ compounds.

16. A non-linear voltage-dependent resistor according to claim 14 wherein the calcined starting material of said coating material includes at least one compound selected from the group of $Zn_{7/3}Sb_{2/3}O_4$, $ZnSb_2O_6$, $SbBiO_4$ and $Zn_2SiO_4$.

17. A non-linear voltage-dependent resistor according to claim 15, wherein said formed element is prefired at a temperature of from 800° to 1,200° C.

18. A non-linear voltage-dependent resistor according to claim 13 wherein said insulating coating includes 20 to 90% of $Zn_{7/3}Sb_{2/3}O_4$ by weight and 0 to 70% of $Zn_2SiO_4$ by weight.

19. A non-linear voltage-dependent resistor according to claim 14, wherein said insulating coating includes 20 to 90% of $Zn_{7/3}Sb_{2/3}O_4$ by weight and 0 to 70% of $Zn_2SiO_4$ by weight.

20. A non-linear voltage-dependent resistor according to claim 7, further including a glass layer formed on the outer surface of said insulating coating.

21. A non-linear voltage-dependent resistor according to claim 13, further including a glass layer formed on the outer surface of said insulating coating.

22. A non-linear voltage-dependent resistor according to claim 15, wherein the calcined starting material of said coating material includes $Zn_{7/3}Sb_{2/3}O_4$ and $Zn_2SiO_4$, wherein said insulating coating has a composition structure of fine $Zn_{7/13}Sb_{2/3}O_4$ grains and fine $Zn_2SiO_4$ grains, each of the latter grains having a size smaller to that of each of the former grains, said grains being very closely packed and arranged.

23. A non-linear voltage-dependent resistor according to claim 16, wherein the calcined starting material of said coating material includes fine $Zn_{7/3}Sb_{2/3}O_4$ and $Zn_2SiO_4$, wherein said insulating coating has a composition structure of fine $Zn_{7/3}Sb_{2/3}O_4$ grains and fine $Zn_2SiO_4$ grains, each of the latter grains having a size similar to that of each of the former grains, said grains being very closely packed and arranged.

* * * * *